US008992085B2

(12) United States Patent
Olin et al.

(10) Patent No.: US 8,992,085 B2
(45) **Date of Patent: *Mar. 31, 2015**

(54) SELF-SUPPORTING STORAGE BAG WITH RESEALABLE POUR SPOUT

(75) Inventors: Alan D. Olin, Menlo Park, CA (US); Diana S. Olin, Menlo Park, CA (US)

(73) Assignees: Alan D. Olin, Menlo Park, CA (US); Diana S. Olin, Menlo Park, CA (US)

( * ) Notice: Subject to any disclaimer, the term of this patent is extended or adjusted under 35 U.S.C. 154(b) by 1491 days.

This patent is subject to a terminal disclaimer.

(21) Appl. No.: 10/723,376

(22) Filed: Nov. 26, 2003

(65) Prior Publication Data

US 2006/0291755 A1 Dec. 28, 2006

Related U.S. Application Data

(60) Continuation-in-part of application No. 10/367,801, filed on Feb. 19, 2003, now Pat. No. 6,857,779, which is a continuation of application No. 09/804,526, filed on Mar. 10, 2001, now abandoned, which is a division of application No. 09/339,702, filed on Jun. 24, 1999, now Pat. No. 6,206,571.

(60) Provisional application No. 60/493,350, filed on Aug. 7, 2003.

(51) Int. Cl.

| | |
|---|---|
| ***B65D 33/16*** | (2006.01) |
| ***B65D 33/00*** | (2006.01) |
| ***B65D 30/16*** | (2006.01) |
| ***B65D 75/00*** | (2006.01) |
| ***B65D 75/58*** | (2006.01) |

(52) U.S. Cl.

CPC ..... *B65D 75/008* (2013.01); *B65D 75/5866* (2013.01)

USPC ..... 383/66; 383/204; 383/61.2; 383/104

(58) Field of Classification Search

USPC ..... 383/66, 104, 203–204, 906, 61.2

See application file for complete search history.

(56) References Cited

U.S. PATENT DOCUMENTS

| | | | |
|---|---|---|---|
| 432,308 A | 7/1890 | Guilbert | |
| 2,020,804 A | 11/1935 | Segal | |

(Continued)

FOREIGN PATENT DOCUMENTS

| | | | |
|---|---|---|---|
| DE | 1112446 | 8/1961 | |
| DE | 3824753 A1 * | 9/1989 | ..... B31B 1/90 |

(Continued)

OTHER PUBLICATIONS

Machine Translation of JP 11-059701 A. Translated on Jun. 10, 2010.*

(Continued)

*Primary Examiner* — Jes F Pascua

(74) *Attorney, Agent, or Firm* — Edward C. Kwok; Hogan Lovells US LLP

(57) ABSTRACT

A reclosable bag or pouch configured to store, and to easily pour, material. The reclosable bag is configured with an integral pour spout having a reclosable fastener to facilitate the pouring of material from the bag, and subsequent resealing. By locating the pour spout along an upper side of the bag, material is focused downward from the bag, and not outward, when poured. Bags configured in this manner thus provide end users with enhanced control over the dispensing rate and direction of their contents. In some embodiments, the bag is also configured as a self-supporting bag capable of resting generally upright upon its bottom end.

28 Claims, 21 Drawing Sheets

(56) References Cited

U.S. PATENT DOCUMENTS

| | | | | | |
|---|---|---|---|---|---|
| 2,188,039 | A | | 1/1940 | Farmer | |
| 2,536,529 | A | | 1/1951 | Bergstein | |
| 2,620,944 | A | | 12/1952 | Stahl | |
| 2,952,394 | A | | 9/1960 | Schneider | |
| 3,051,368 | A | | 8/1962 | Schneider et al. | |
| 3,074,612 | A | | 1/1963 | Schneider | |
| 3,077,295 | A | | 2/1963 | Whiteford | |
| 3,143,277 | A | | 8/1964 | LaFleur | |
| 3,367,380 | A | | 2/1968 | Dickey | |
| 3,380,646 | A | * | 4/1968 | Doyen et al. | 383/104 |
| 3,387,701 | A | | 6/1968 | Schneider et al. | |
| 3,412,918 | A | * | 11/1968 | Sherman | 383/200 |
| 3,417,675 | A | | 12/1968 | Ausnit | |
| 3,502,521 | A | | 3/1970 | Doyen et al. | |
| 3,504,841 | A | | 4/1970 | Bramson | |
| 3,520,471 | A | | 7/1970 | Faust | |
| 3,640,381 | A | | 2/1972 | Kanada et al. | |
| 3,815,810 | A | | 6/1974 | Wellman | |
| 3,935,993 | A | * | 2/1976 | Doyen et al. | 383/94 |
| 4,027,819 | A | | 6/1977 | Herrera-Gutierrez | |
| 4,171,755 | A | | 10/1979 | Carlisle | |
| 4,176,567 | A | * | 12/1979 | Weisberg | 83/30 |
| 4,332,344 | A | | 6/1982 | Strodthoff | |
| 4,454,979 | A | | 6/1984 | Ikeda et al. | |
| 4,759,642 | A | | 7/1988 | Van Erden et al. | |
| 4,787,755 | A | | 11/1988 | Branson | |
| 4,946,289 | A | | 8/1990 | Bolling et al. | |
| 4,953,708 | A | | 9/1990 | Beer et al. | |
| 4,974,732 | A | * | 12/1990 | Sullivan et al. | 222/541.6 |
| 5,007,744 | A | | 4/1991 | Scarberry et al. | |
| 5,060,803 | A | | 10/1991 | Beer et al. | |
| 5,080,253 | A | | 1/1992 | Zieke | |
| 5,104,235 | A | | 4/1992 | Bronstrup et al. | |
| RE34,347 | E | | 8/1993 | Van Erden et al. | |
| 5,525,363 | A | | 6/1996 | Herber et al. | |
| 5,593,229 | A | | 1/1997 | Warr | |
| 5,609,420 | A | | 3/1997 | Palmisano | |
| 5,611,626 | A | | 3/1997 | Warr | |
| D383,060 | S | * | 9/1997 | Pfuhl et al. | D9/708 |
| 5,687,848 | A | | 11/1997 | Scholz et al. | |
| 5,716,473 | A | | 2/1998 | Gordon et al. | |
| 5,941,643 | A | | 8/1999 | Linkiewicz | |
| 6,007,246 | A | | 12/1999 | Kinigakis et al. | |
| 6,053,635 | A | | 4/2000 | Anderson et al. | |
| 6,164,826 | A | | 12/2000 | Petkovsek | |
| 6,206,571 | B1 | | 3/2001 | Olin | |
| 6,409,386 | B1 | | 6/2002 | Trani et al. | |
| 6,719,678 | B1 | * | 4/2004 | Stern | 493/212 |
| 6,817,160 | B2 | * | 11/2004 | Schmidt | 53/412 |
| 6,857,779 | B2 | * | 2/2005 | Olin | 383/204 |
| 7,011,448 | B2 | * | 3/2006 | Olin | 383/66 |

FOREIGN PATENT DOCUMENTS

| | | | | | |
|---|---|---|---|---|---|
| FR | 1 359 333 | | | 3/1963 | |
| FR | 1359333 | | | 3/1964 | |
| FR | 2 639 325 | | | 5/1990 | |
| FR | 2639325 | | | 5/1990 | |
| JP | 0212355 | | | 9/1991 | |
| JP | 0240650 | | | 10/1991 | |
| JP | 0240651 | | | 10/1991 | |
| JP | 03289451 | A | * | 12/1991 | B65D 33/25 |
| JP | 06183459 | A | * | 7/1994 | B65D 77/30 |
| JP | 09002488 | A | * | 1/1997 | B65D 30/10 |
| JP | 11059701 | A | * | 3/1999 | B65D 33/38 |
| JP | 2000043902 | A | * | 2/2000 | B65D 33/38 |
| JP | 2001151247 | A | * | 6/2001 | B65D 33/00 |
| JP | 2001301775 | A | * | 10/2001 | B65D 33/38 |
| WO | WO 9611859 | A1 | * | 4/1996 | B65D 75/00 |

OTHER PUBLICATIONS

Z-Patch, Inc., Z-Patch In-Line Zipper Application System, Carbondale, IL 62901.

Z-Patch Inc., Z-Patch In-Line Zipper Application System, Carbondale, IL 62901.

* cited by examiner

SELF-SUPPORTING STORAGE BAG WITH RESEALABLE POUR SPOUT

CROSS-REFERENCE TO RELATED APPLICATIONS

This application is a continuation-in-part of U.S. patent application Ser. No. 10/367,801, filed on Feb. 19, 2003, now U.S. Pat. No. 6,857,779 which is a continuation of U.S. patent application Ser. No. 09/804,526, filed on Mar. 10, 2001, now abandoned, which is a divisional of U.S. patent application Ser. No. 09/339,702, filed on Jun. 24, 1999, now U.S. Pat. No. 6,206,571; this application also claims the benefit of U.S. Provisional Application No. 60/493,350, which was filed on Aug. 7, 2003.

BRIEF DESCRIPTION OF THE INVENTION

This invention relates generally to storage bags. More specifically, this invention relates to self-supporting storage bags with resealable pour spouts.

BACKGROUND OF THE INVENTION

Reclosable storage bags are commonly used to store a wide variety of materials. For example, such bags are often employed in the packaging industry to store dry goods such as cereal and other foodstuffs, and are used by consumers to store preprepared foods and leftovers.

Such storage bags are, however, not without their drawbacks. It is often difficult and messy to pour goods from these bags, as they typically lack a dedicated pour spout specifically designed to make the pouring process easier. Similarly, many reclosable storage bags, especially flexible storage bags, are not capable of standing upright by themselves, often toppling over easily. This often risks spills, especially if liquid goods are stored or if the reclosable seal happens to open.

It would therefore be desirable to design a reclosable storage bag with a pour spout for facilitating easy and clean pouring of material. It would further be desirable to design a self-supporting reclosable storage bag capable of standing upright by itself.

SUMMARY OF THE INVENTION

A reclosable bag comprises a bag configured to store material, the bag having top and bottom ends, first and second side edges each extending between the top and bottom ends and opposite each other, and a pour spout. The pour spout has a reclosable fastener located proximate to and oriented substantially parallel to the first side edge. The reclosable fastener is located closer to the top end than to the bottom end, and the bag is configured to rest upon the bottom end.

Bags configured in this manner thus provide end users with enhanced control over the dispensing rate and direction of their contents. By locating the pour spout along an upper side of the bag, material is focused downward from the bag, and not outward, when poured. Such bags are also self-supporting and can stand generally upright when placed on their bottom ends, thus minimizing the risk of spills.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF THE INVENTION

Figure 1:
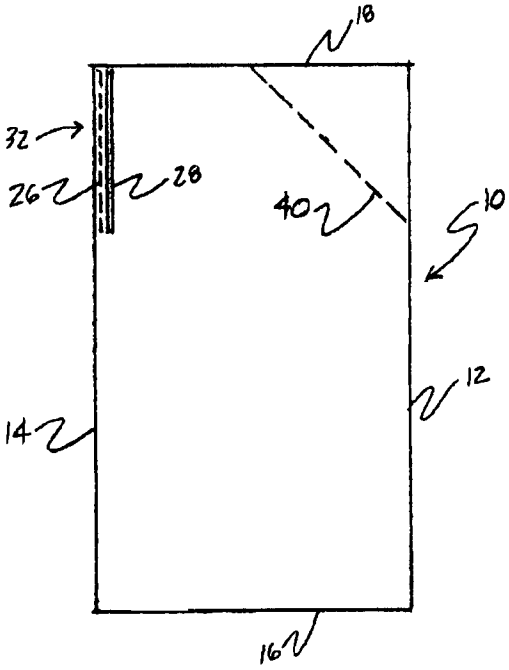
FIG. 1 is a front view of a reclosable standup pouch or bag of the present invention.

FIG. 1 illustrates the front view of a reclosable standup pouch or bag 10 for the packaging of pourable materials such as dry cereal or other goods. The reclosable standup pouch or bag 10 may be formed from a single sheet of material or several sheets of material to define an interior space for holding pourable material. The material of the bag 10 may be a single layer or a multi-layer of plastic, paper, metalized plastic, or any other material suitable for containing pourable goods, which will over lengthy storage periods preserve the freshness and integrity of the contents stored therein when sealed or resealed by the consumer. As shown here, bag 10 has sealed bottom and top edges 16 and 18, respectively, that each have an end meeting right and left sealed side edges 12 and 14, respectively, substantially perpendicularly. The top of left side edge 14 is shown defining an opening in the form of a pour spout 32 that is shown in this view as having a length that is approximately one third the overall length of left side edge 14. However the length of this opening could be longer or shorter than that shown depending on the particle size of the material to be placed in the bag.

Pour spout 32 in this view includes a reclosable fastener 28 which, when closed, completes the sealing of left side edge 14 with one end of fastener 28 sealed to the top most point of the permanent seal of left side edge 14 and the other end of fastener 28 sealed to the left end (as shown in this view) of top edge 18. The reclosable fastener 28 may be a zipper, a slider, or any other mechanism that allows someone to open, reclose and reopen the pouch or bag as many times as desired to pour the desired amount of material from the interior of bag 10 and to keep the remaining material in bag 10 sealed until a later time when the user desires more. By locating the pour spout along the upper left side 14 of the bag, material is focused downward from the bag, and not outward, when poured. Bags configured in this manner thus provide end users with enhanced control over the dispensing rate and direction of their contents.

Also shown here, external to reclosable fastener 28, is a tear strip 26 which is used to show the consumer at the time of purchase that bag 10 contains all of the product placed therein by the manufacturer and that it has not been tampered with prior to purchase. Additionally, tear strip 26 helps to retain reclosable fastener 28 closed throughout handling and shipping of bag 10. Further, tear strip 26 provides an easy way for the consumer to open bag 10 the first time. Optionally, the perforations of tear strip 26 could be omitted to provide more secure closure of pour spout 32 with handling and shipping stresses. Without perforations the consumer would be able to open tear strip 26 by tearing it along the full length thereof or cutting it.

Additionally, FIG. 1 shows an optional secondary seal 40 to seal the interior of the front and back layers of the bag together internally. This secondary seal 40 creates a sealed portion of the bag 10 (in this configuration, the triangular portion above the seal 40) that is shaped to assist in directing the contents of the bag toward pour spout 32 and control the flow of product from bag 10 when the consumer tilts the bag to pour the contents from the pour spout 32. Such a secondary seal 40 can be used in each of the square top bag embodiments discussed herein. Optionally, a modified version of FIGS. 1 to 36, 39 and 40 could include only a reclosable fastener 28 or only a tear strip 26.

The bottom edge 16 is located at the bottom end (as the bag is oriented in FIG. 1) of the bag 10 of FIG. 1, and is generally constructed as a gusseted edge or other edge having a distinct width (i.e., the dimension perpendicular to the plane of FIG. 1). In the embodiment of FIG. 1, the bottom edge 16 is of sufficient width to allow the bag 10 to be self-supporting, so as to maintain a generally upright configuration when the bag 10 is placed on its bottom edge 16. In this manner, the risk of spills is minimized.

Figure 2:
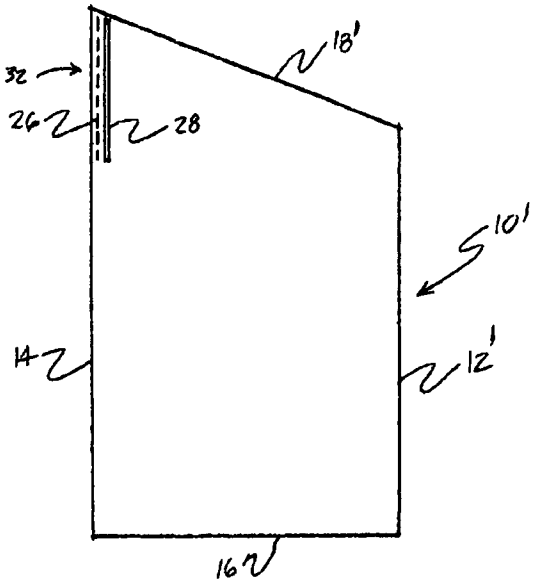
FIG. 2 is a front view of a modified reclosable standup pouch or bag of FIG. 1.

FIG. 2 depicts a front view of a reclosable standup pouch or bag 10' that is similar to that shown in FIG. 1 with one variation. The variation incorporated into FIG. 2 is sloping sealed top edge 18'. Sealed top edge 18' slopes with respect to the sealed bottom edge 16 with an included acute (i.e., measuring less than 90 degrees) angle between sealed left side edge 14 and the sealed top edge 18', and an included obtuse (i.e., measuring greater than 90 degrees) angle between the sealed right side edge 12' and the sealed top edge 18' with right side edge 12' being shorter than left side edge 14. In FIGS. 1 and 2, a pour spout 32 is located on the upper left side of the reclosable standup pouches or bags 10, disposed between the sealed left side edge 14 and the sealed top edge 18, and includes a tear strip 26 that is longitudinally oriented and located outwardly of the longitudinally oriented reclosable fastener 28.

Figure 4:
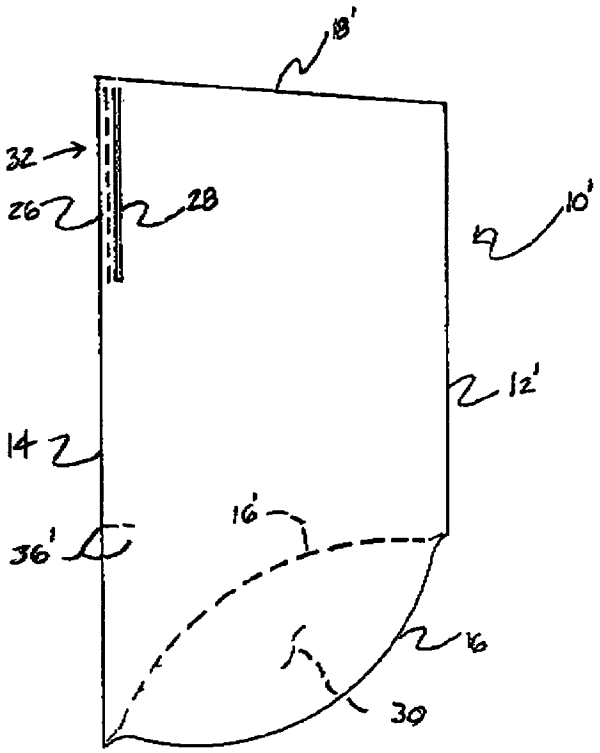
FIG. 4 is a perspective view of the reclosable standup pouch or bag of FIG. 2.
Figure 3:
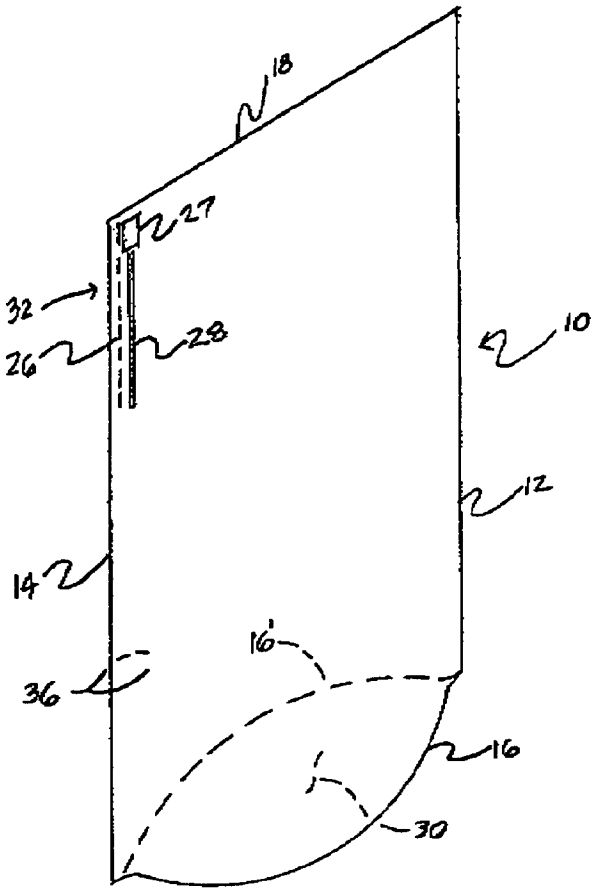
FIG. 3 is a perspective view of the reclosable standup pouch or bag of FIG. 1.

FIGS. 3 and 4 show perspective views of bags 10 and 10' of FIGS. 1 and 2, respectively. Both are reclosable standup pouches or bags 10 and 10', including front and back panels 36 and 36' respectively, with each of the bags 10 and 10' having a bag bottom end 30, which is ovoid in shape sealed along bottom edges 16 and 16' and the bottom ends of sides 12 and 14, and 12' and 14', respectively. The ovoid shaped bottom end 30 allows the bags 10, 10' to support themselves by resting upon their bottom end 30 in a generally upright position. For Purposes of example, the sides 12 and 12', and 14 and 14', are shown as non-gusseted sides. In Particular, the sides 14 and 14' are shown having non-gusseted portions below the pour spout 32. Also for purposes of example, reclosable fastener 28 is shown as having a slider 27 for more convenient opening and closing by the user.

Figure 6:
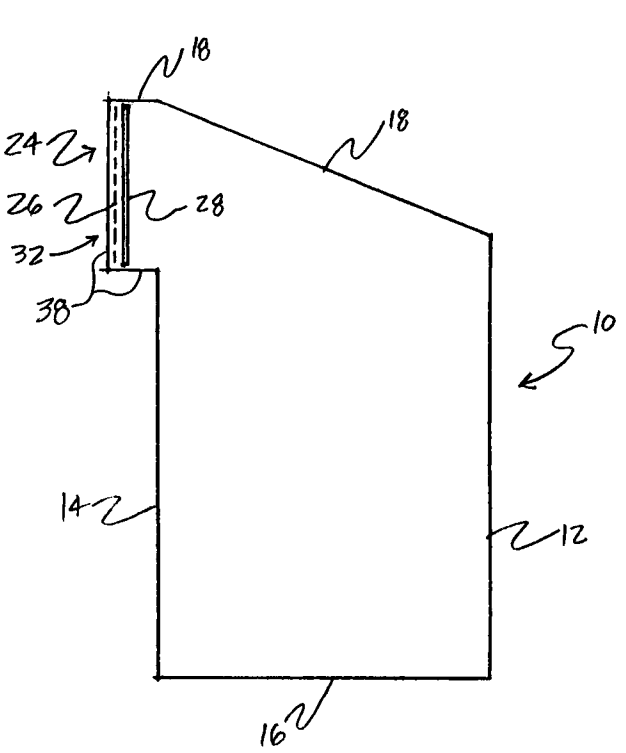
FIG. 6 is a front view of another modification of the reclosable standup pouch or bag of FIG. 2.
Figure 5:
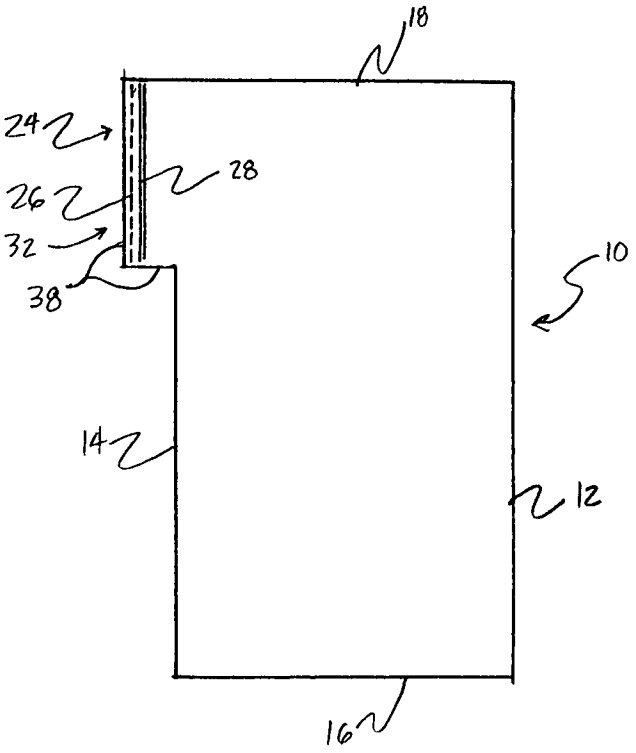
FIG. 5 is a front view of another modified reclosable standup pouch or bag of FIG. 1.

FIGS. 5 and 6 depict front views of a reclosable standup pouch or bag 10, which includes another variation of the present invention as shown in FIGS. 1 and 2, respectively. In this embodiment, pour spout 32 includes a spout extension 24 from the upper left side 14 of the reclosable standup pouch or bag 10, and disposed between the sealed left side 14 and the sealed top edge 18. The spout extension 24 has sealed edges 38 and a tear strip 26 that are longitudinally oriented and located outwardly from the vertical, sealed portion of left side 14. The spout extension 24 extends beyond the left side 14, to further define the pour spout 32 and facilitate the pouring of material from the bag. In these views reclosable fastener 28 is shown just inward from the open end of spout extension 24, however, reclosable fastener 28 can be located anywhere between the location shown in FIGS. 5 and 6 or the location in FIGS. 1 and 2.

Figure 8:
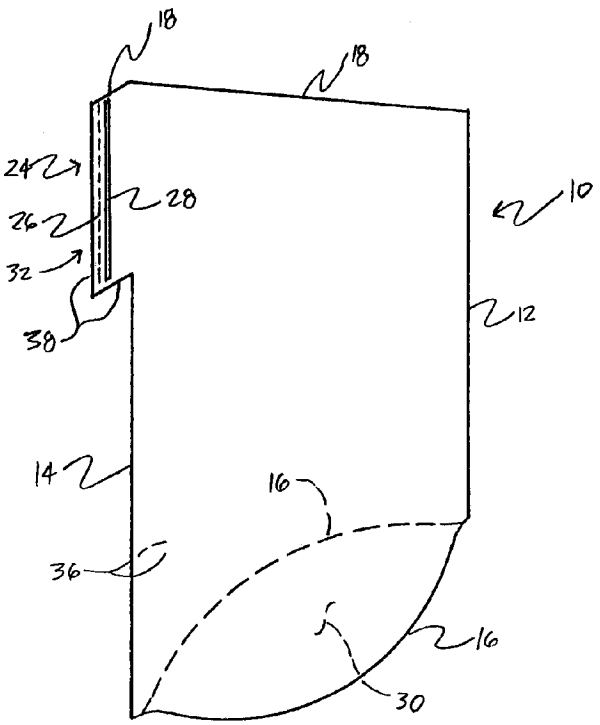
FIG. 8 is a perspective view of the reclosable standup pouch or bag of FIG. 6.
Figure 7:
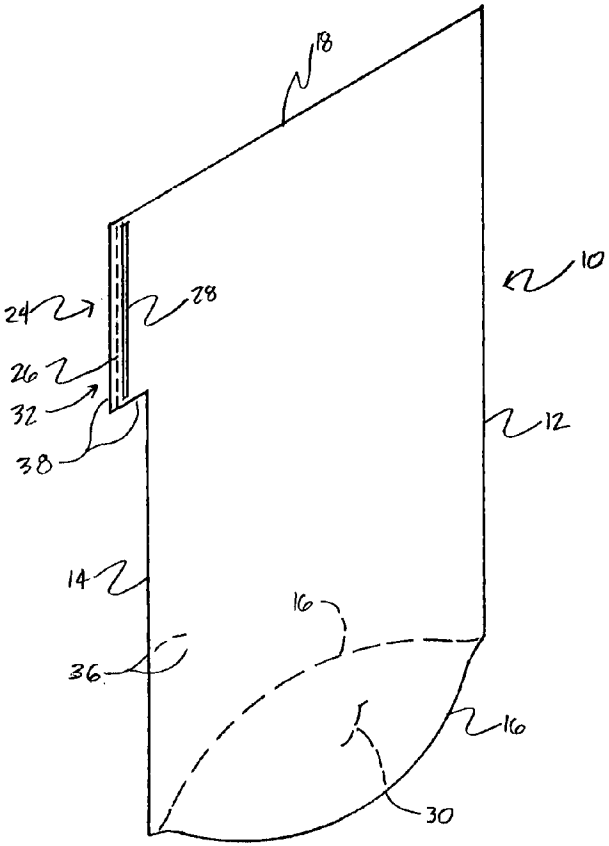
FIG. 7 is a perspective view of the reclosable standup pouch or bag of FIG. 5.

FIGS. 7 and 8 are perspective views of FIGS. 5 and 6, respectively. Each of FIGS. 7 and 8 show a reclosable standup pouch or bag 10 that includes the front and back panels 36 and the bag bottom end 30, which is ovoid in shape, as shown in FIGS. 3 and 4 and discussed above.

Figure 10:
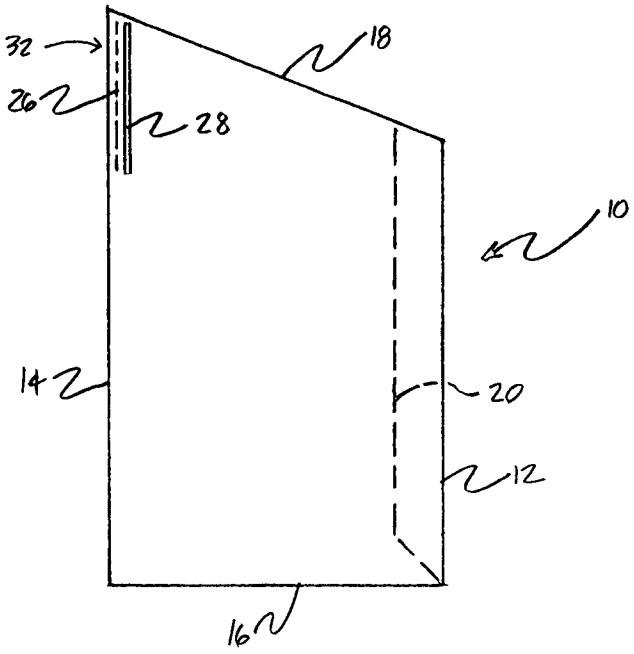
FIG. 10 is a front view of another modification of the reclosable standup pouch or bag of FIG. 2.
Figure 9:
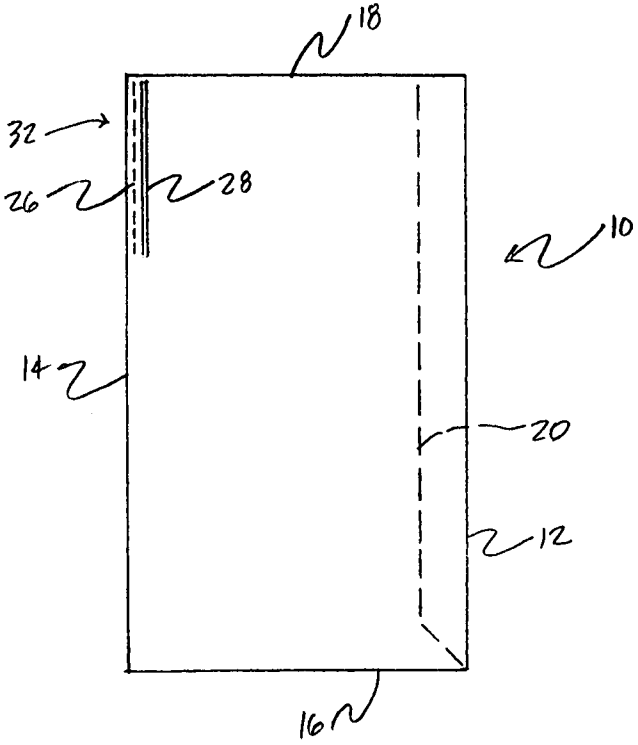
FIG. 9 is a front view of another modification of the reclosable standup pouch or bag of FIG. 1.

FIGS. 9 and 10 show another embodiment of the present invention that is similar to that of FIGS. 1 and 2 with the addition of a right side gusset 20 that extends between the sealed bottom edge 16 and the sealed top edge 18, thus allowing the right side edge 12 to expand. Such an expanding gusset thus allows the bag to hold more material than it otherwise could.

Figure 12:
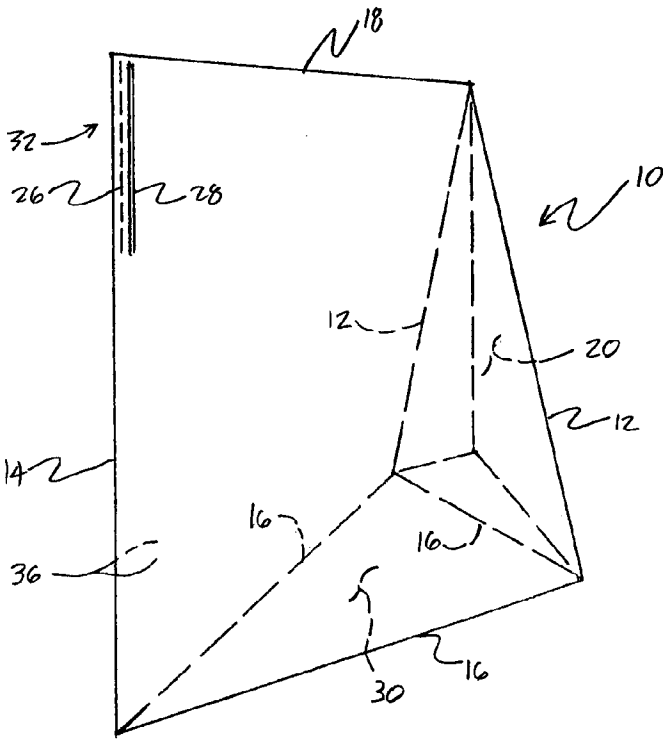
FIG. 12 is a perspective view of the reclosable standup pouch or bag of FIG. 10.
Figure 11:
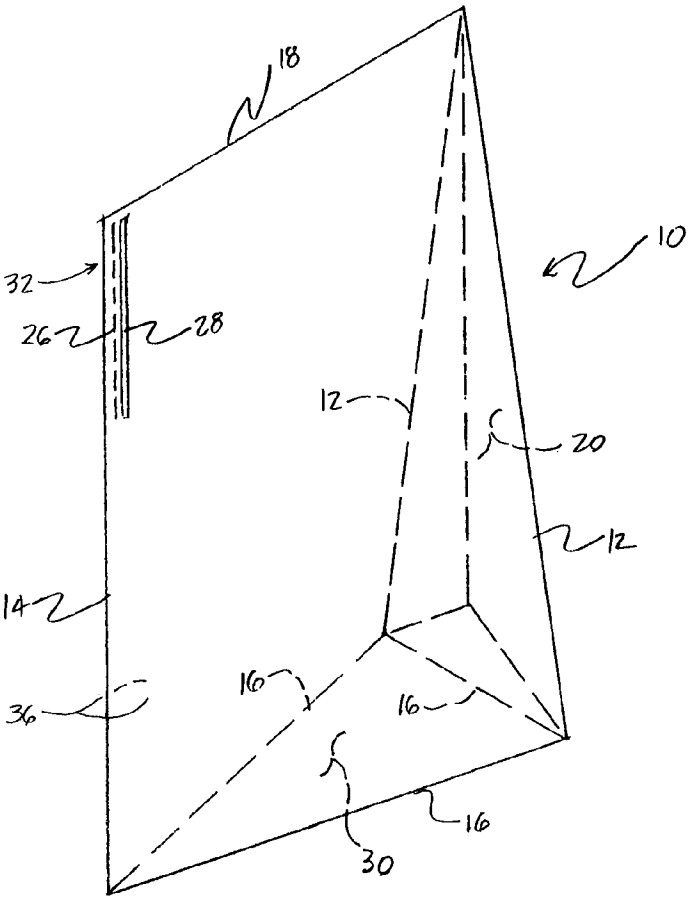
FIG. 11 is a perspective view of the reclosable standup pouch or bag of FIG. 9.

FIGS. 11 and 12 are perspective views of the bags of FIGS. 9 and 10, respectively. Both are reclosable standup pouches or bags 10 that include the front and back panels 36, triangular bag bottom 30, and right side gusset 20 that is also triangular in shape when fully opened. Similar to the ovoid bottom of FIGS. 3 and 4, the triangular bottom 30 helps create a self-supporting bag 10 capable of resting upon its bottom end without any further support.

Figure 14:
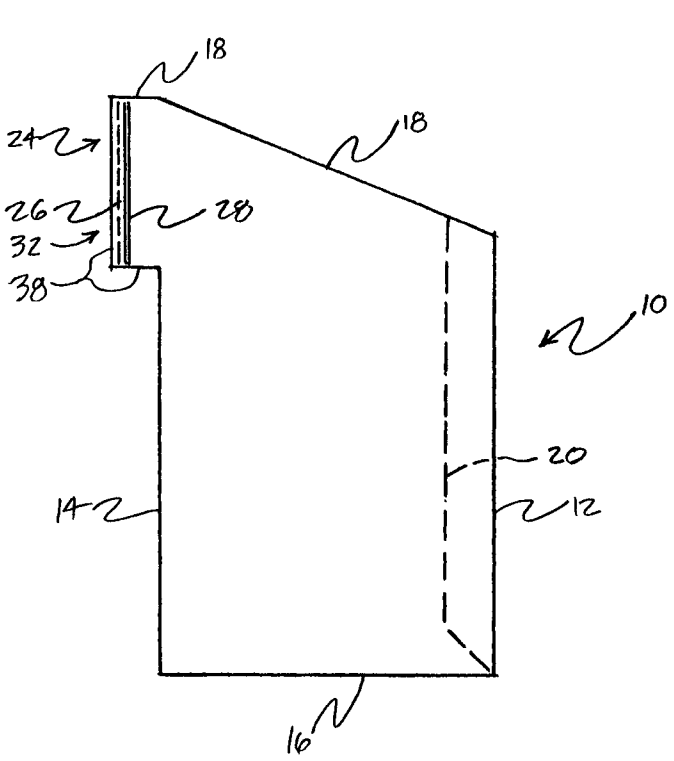
FIG. 14 is a front view of another modification of the reclosable standup pouch or bag of FIG. 10.
Figure 13:
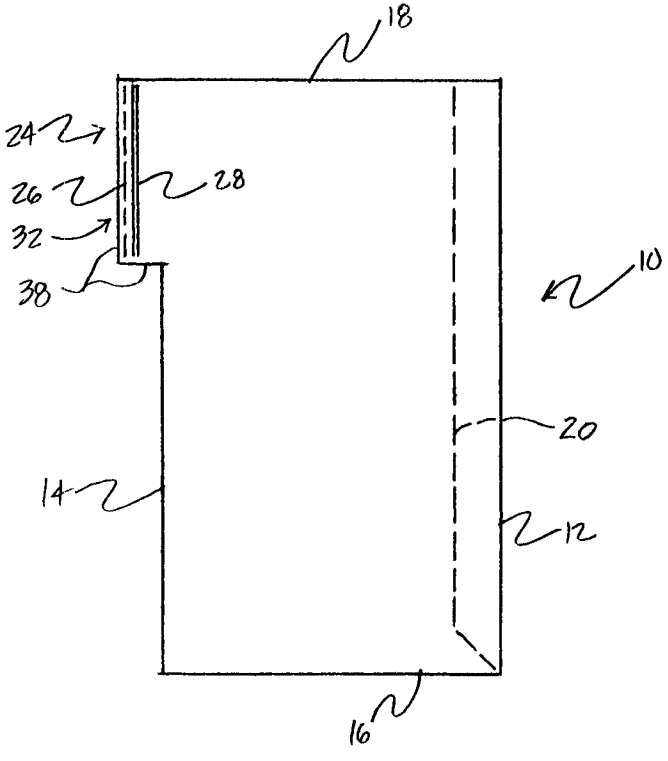
FIG. 13 is a front view of another modification of the reclosable standup pouch or bag of FIG. 9.

FIGS. 13 and 14 depict front views of another embodiment of the reclosable standup pouch or bag of the present invention. FIG. 13 is essentially a combination of FIGS. 5 and 9, and FIG. 14 is a combination of FIGS. 6 and 10. In this embodiment, the pour spout 32 is formed by the spout extension 24, which is located on the upper left side of the reclosable standup pouch or bag 10, and disposed between the sealed left side edge 14 and the sealed top edge 18. The spout extension 24 has sealed edges 38 and a tear strip 26 that is longitudinally oriented and located outwardly of the longitudinally oriented reclosable fastener 28.

Figure 16:
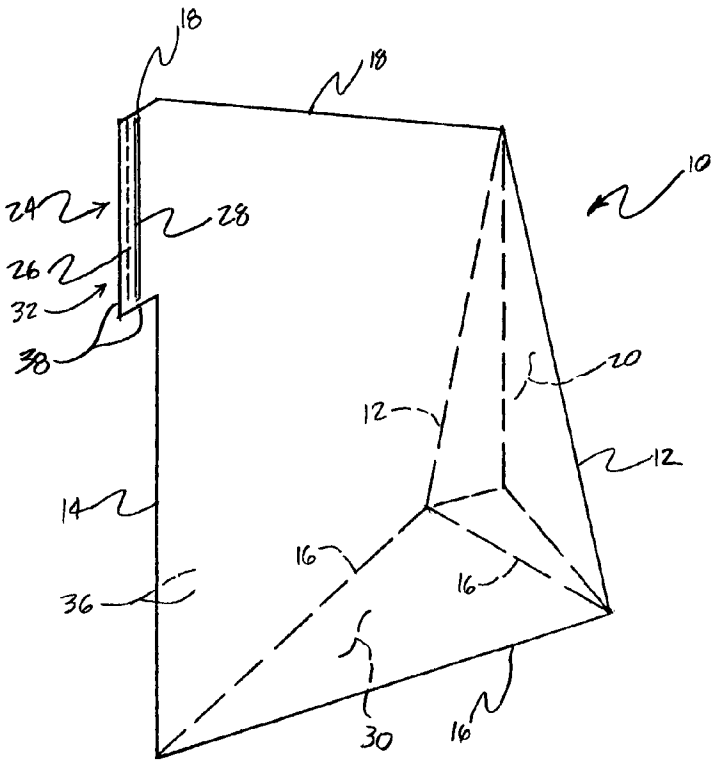
FIG. 16 is a perspective view of the reclosable standup pouch or bag of FIG. 14.
Figure 15:
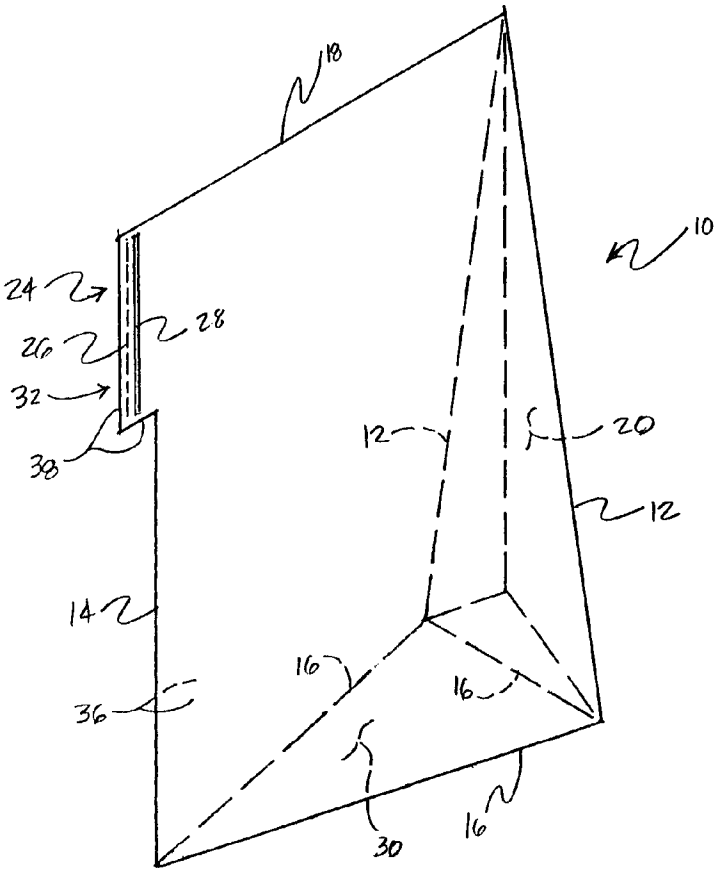
FIG. 15 is a perspective view of the reclosable standup pouch or bag of FIG. 13.

FIGS. 15 and 16 are perspective views of the bags shown in FIGS. 13 and 14, respectively. Both are reclosable standup pouches or bags 10 that include front and back panels 36, triangular bag bottoms 30, and right side gusset 20, which is also triangular in shape when fully open.

Figure 18:
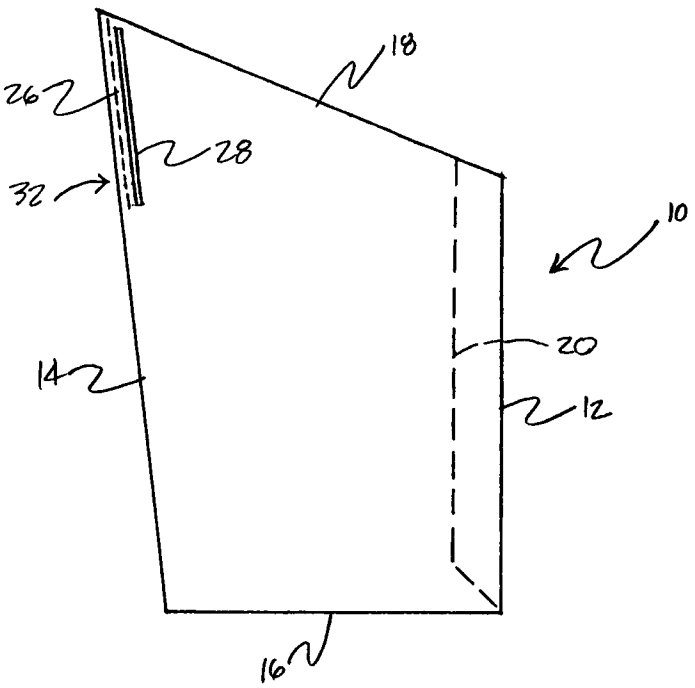
FIG. 18 is a front view of another modification of the reclosable standup pouch or bag of FIG. 10.
Figure 17:
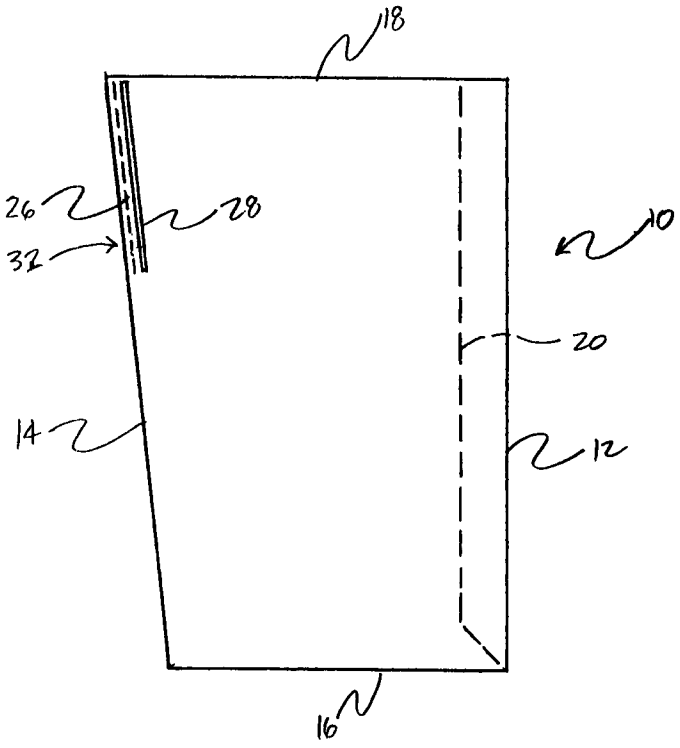
FIG. 17 is a front view of another modification of the reclosable standup pouch or bag of FIG. 9.

FIGS. 17 and 18 depict front views of another embodiment of reclosable standup pouch or bag 10 that is a variation of the bags shown in FIGS. 9 and 10, respectively. In this embodiment, the sealed left side edge 14 is sloped with respect to the sealed right side edge 12 with an included acute angle between the sealed left side edge 14 and the sealed top edge 18 and an included obtuse angle between the sealed left side edge 14 and the sealed bottom edge 16. The right side edge 12 is connected to the top and bottom edges 18 and 16 respectively, as previously discussed with the right side gusset 20 also as previously discussed. Additionally, tear strip 26 is parallel with and disposed adjacent to the permanently sealed portion of left side edge 14 and parallel with and located outwardly of the reclosable fastener 28.

Figure 20:
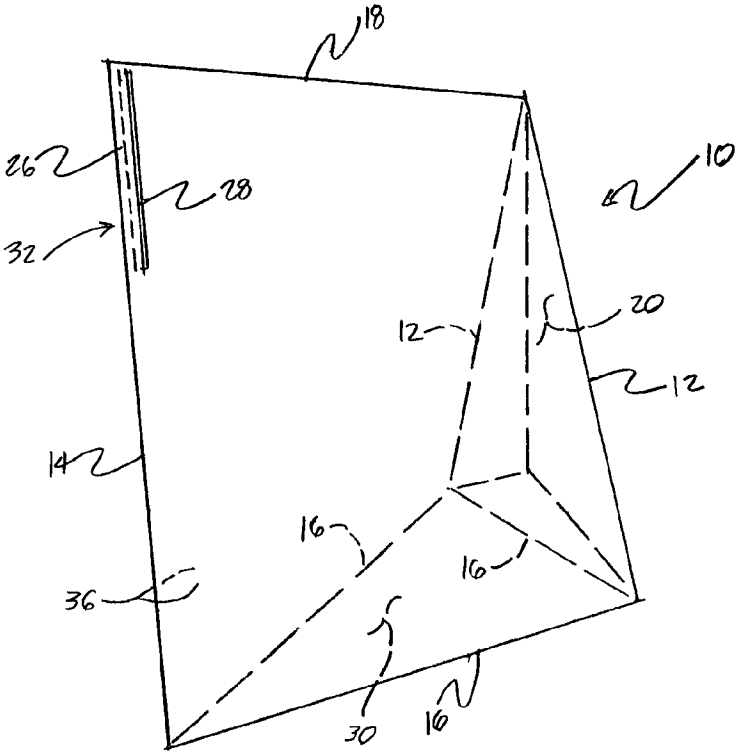
FIG. 20 is a perspective view of the reclosable standup pouch or bag of FIG. 18.
Figure 19:
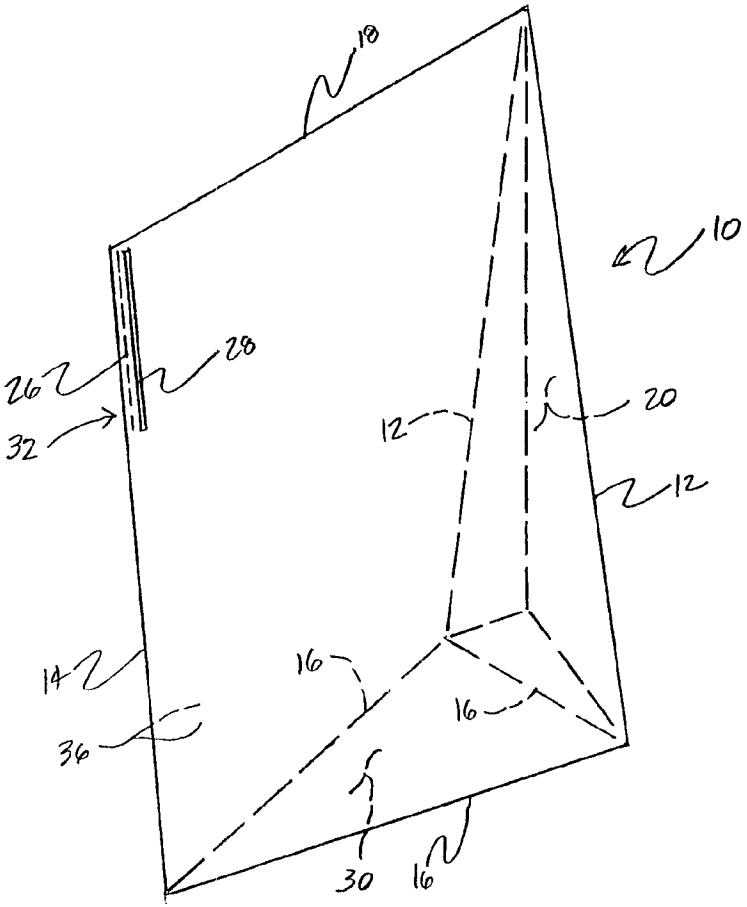
FIG. 19 is a perspective view of the reclosable standup pouch or bag of FIG. 17.

FIGS. 19 and 20 present perspective views of the bags of FIGS. 17 and 18, respectively. Both are reclosable standup pouches or bags 10, including the front and back panels 36, triangular bag bottom 30, and right side gusset that is triangular when fully opened, as previously discussed.

Figure 22:
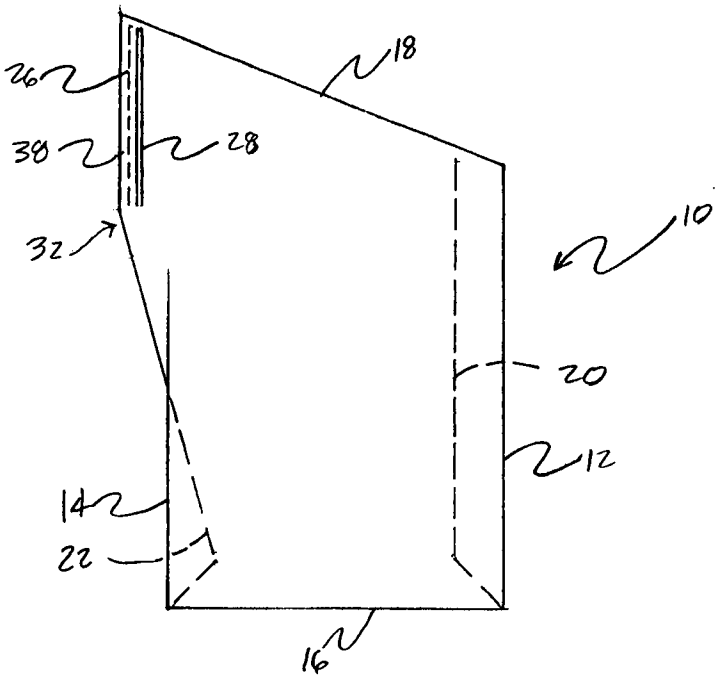
FIG. 22 is a front view of another modification of the reclosable standup pouch or bag of FIG. 10.
Figure 21:
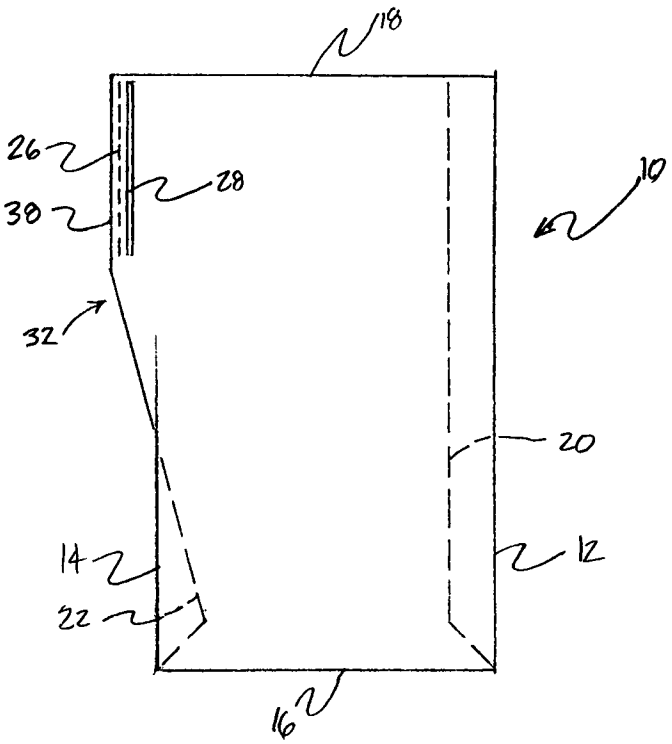
FIG. 21 is a front view of another modification of the reclosable standup pouch or bag of FIG. 9.

FIGS. 21 and 22 are a variation of FIGS. 9 and 10, respectively, which each depict front views of a reclosable standup pouch or bag 10 that includes both a right and a left side gusset 20 and 22, respectively. In this embodiment, a right side gusset 20 is as in FIGS. 9 and 10 and discussed above in relation to those figures. Left side gusset 22 extends between the sealed bottom edge 16 and pour spout 32, with pour spout 32 extending between the top of left side gusset 22 and sealed top edge 18 and including a tear strip 26 that is longitudinally oriented and disposed adjacent to a parallel sealed edge 38 and located outwardly of the longitudinally oriented reclosable fastener 28. The pour spout 32 is formed by reversing the left side gusset 22 (in other words, an outward folded gusset as opposed to the typical inward folded gusset on the right side of the bag), which then eliminates the sealed left side edge 14 at a point between the sealed bottom edge 16 and the sealed top edge 18. By folding the left side gusset 22 and connecting it to the pour spout 32, the left side gusset 22 becomes shaped so as to assist in pouring material through the pour spout 32.

Figure 23:
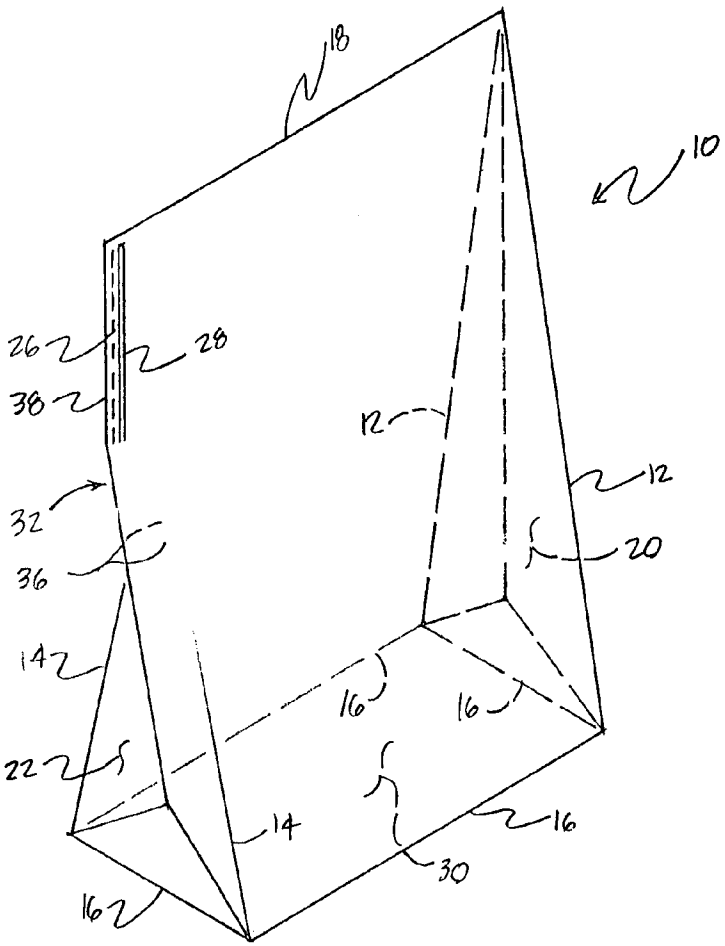
FIG. 23 is a perspective view of the reclosable standup pouch or bag of FIG. 21.
Figure 24:
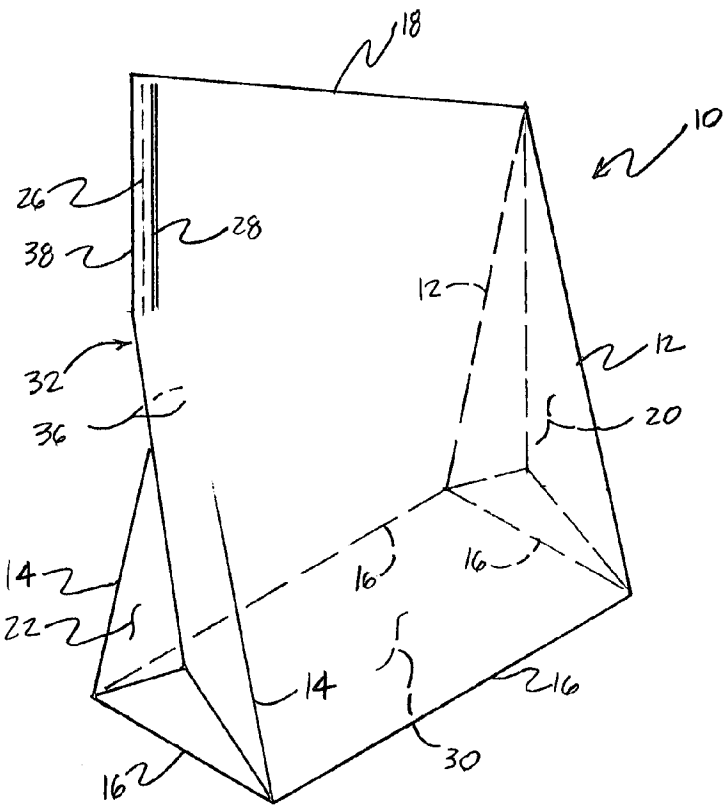
FIG. 24 is a perspective view of the reclosable standup pouch or bag of FIG. 22.

FIGS. 23 and 24 are perspective views of the bags of FIGS. 21 and 22, respectively. Both are reclosable standup pouches or bags 10 that each include front and back bag panels 36, a rectangular bag bottom 30, an inward folded triangular right side gusset 20 as previously discussed, and an outward folded triangular left side gusset 22.

Figure 26:
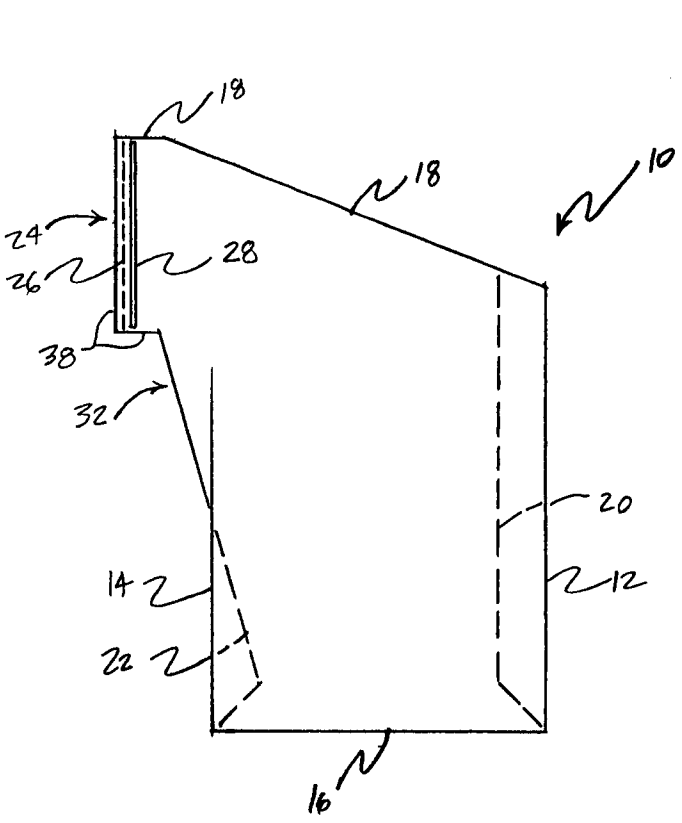
FIG. 26 is a front view of a modification of the reclosable standup pouch or bag of FIG. 22.
Figure 25:
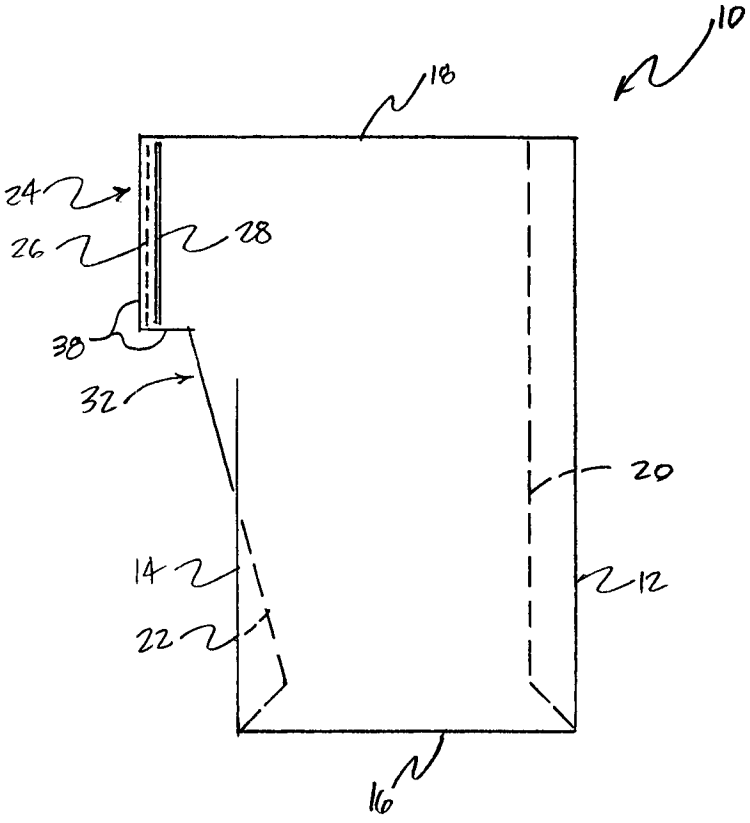
FIG. 25 is a front view of a modification of the reclosable standup pouch or bag of FIG. 21.

FIGS. 25 and 26 depict front views of bags that are a combination of the bags shown in FIGS. 21 and 22 together with FIGS. 5 and 6, showing an outwardly extending pour spout 32. In this embodiment, the pour spout 32 includes spout extension 24, which is located on the upper left side of the reclosable standup pouch or bag 10, and disposed between the sealed left side edge 14 portion of outward folded left side gusset 22 and the sealed top edge 18. The spout extension 24 has sealed edges 38 and a tear strip 26 that is longitudinally oriented and located outwardly of the longitudinally oriented reclosable fastener 28.

Figure 28:
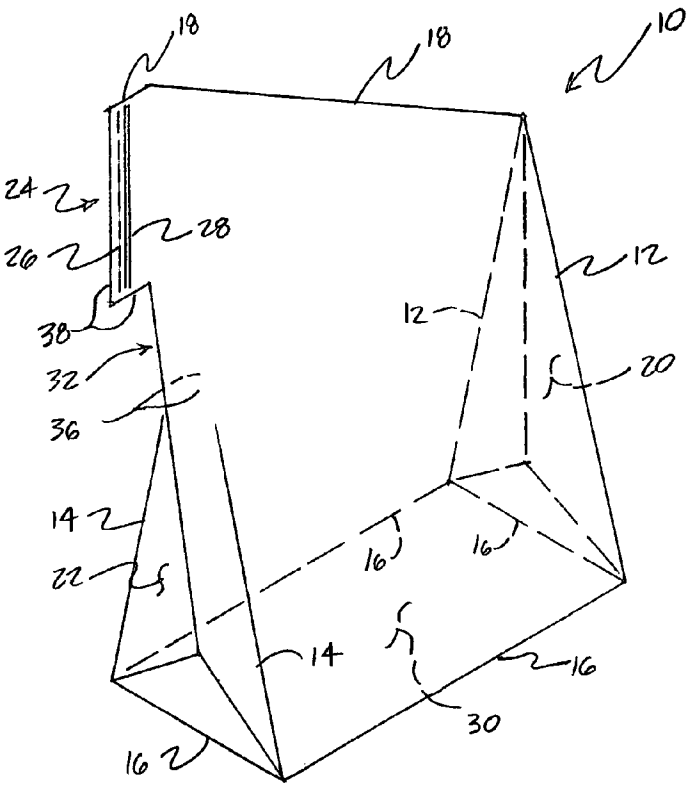
FIG. 28 is a perspective view of the reclosable standup pouch or bag of FIG. 26.
Figure 27:
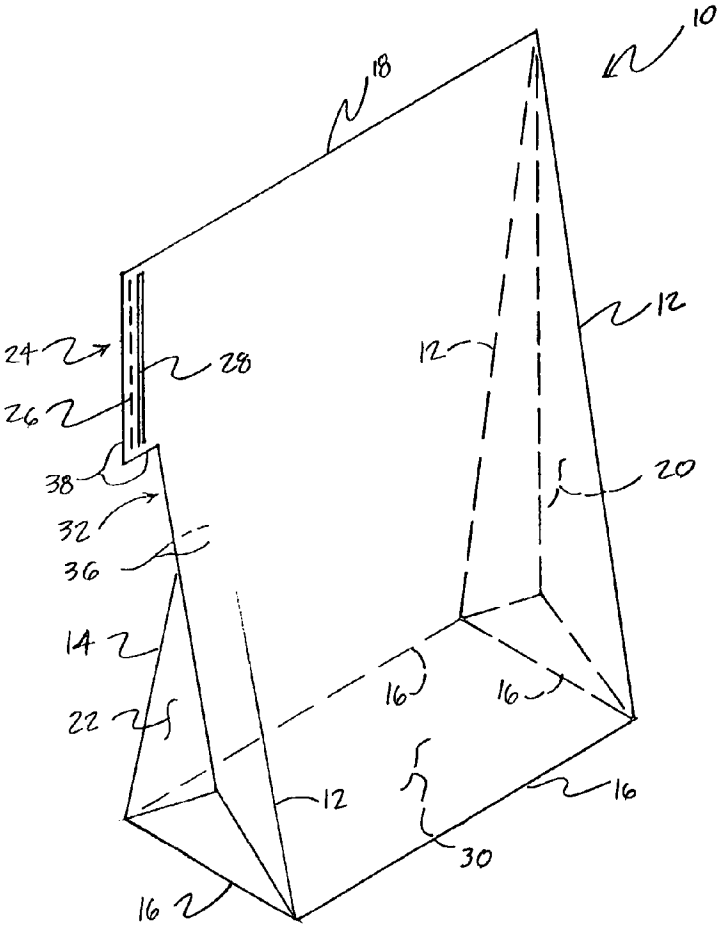
FIG. 27 is a perspective view of the reclosable standup pouch or bag of FIG. 25.

FIGS. 27 and 28 show perspective views of the bags of FIGS. 25 and 26, respectively, and are similar to FIGS. 23 and 24, respectively, with the outward extending pour spout 32 discussed above.

Figure 30:
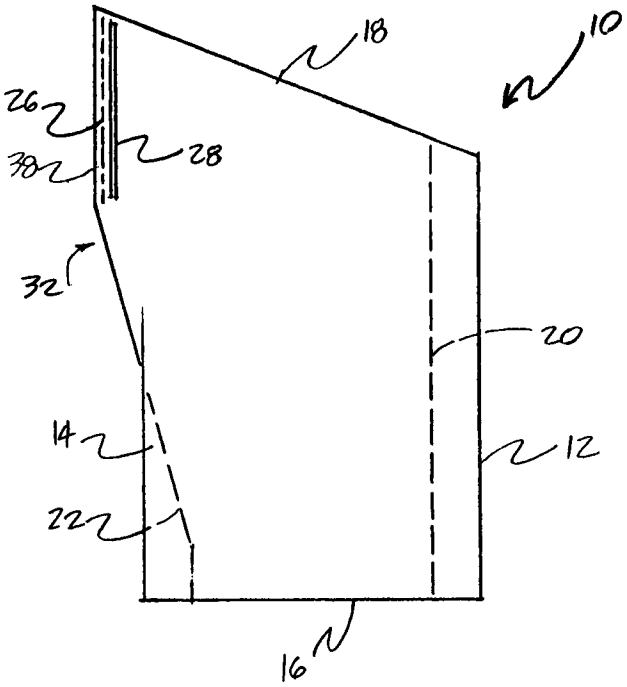
FIG. 30 is a front view of another modification of the reclosable standup pouch or bag of FIG. 22.
Figure 29:
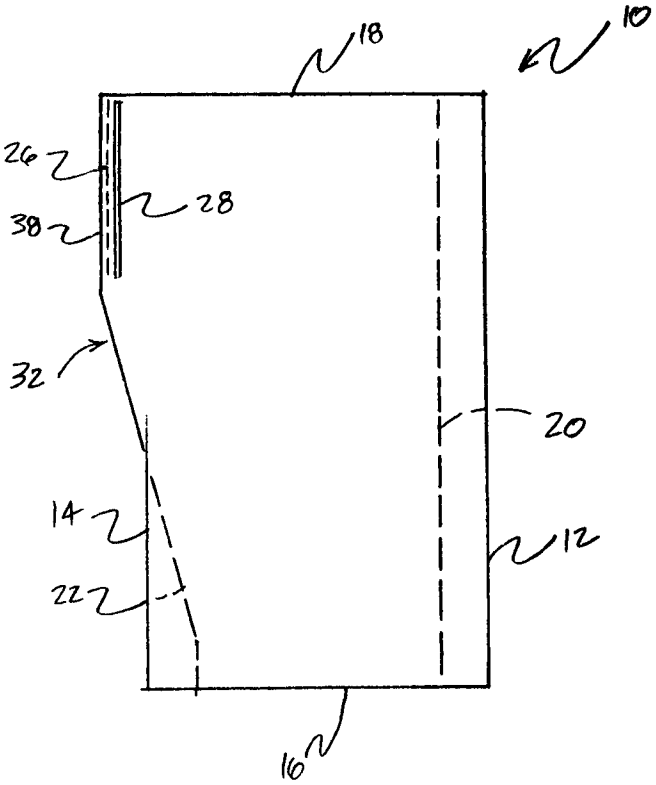
FIG. 29 is a front view of another modification of the reclosable standup pouch or bag of FIG. 21.

FIGS. 29 and 30 are front views of reclosable standup pouches or bags 10 that are similar to the bags shown in FIGS. 21 and 22, respectively, with left side gusset 22 folded outward instead of inward as discussed above.

Figure 31:
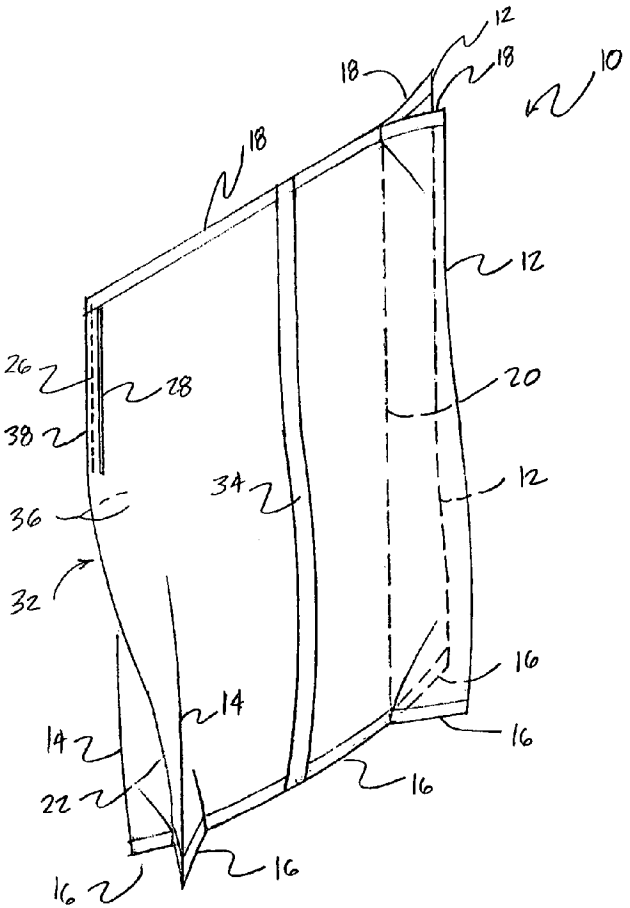
FIG. 31 is a perspective view of the reclosable standup pouch or bag of FIG. 29.
Figure 32:
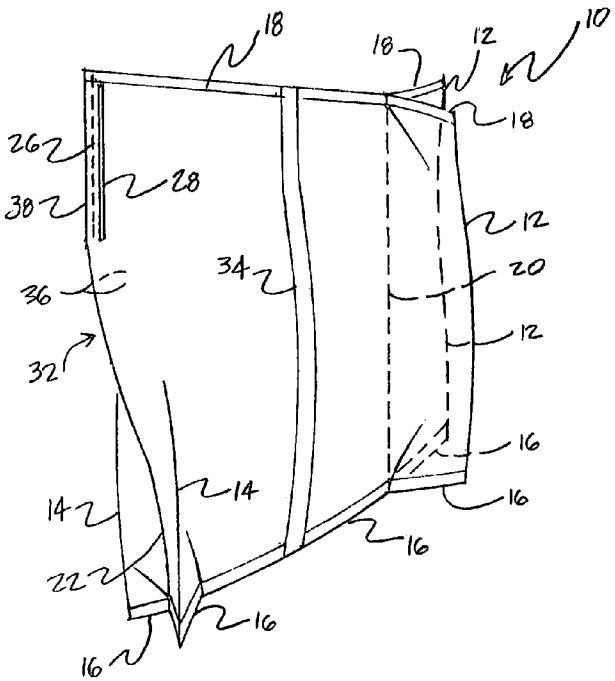
FIG. 32 is a perspective view of the reclosable standup pouch or bag of FIG. 30.
Figure 38:
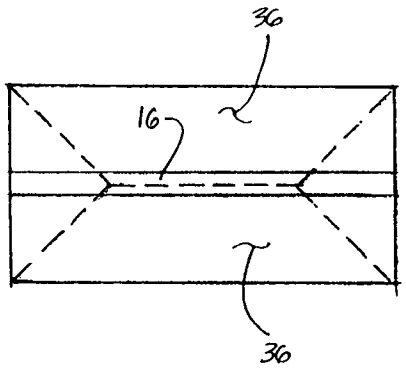
FIG. 38 is a bottom view of FIGS. 31, 32, 35, and 36, after being filled.
Figure 37:
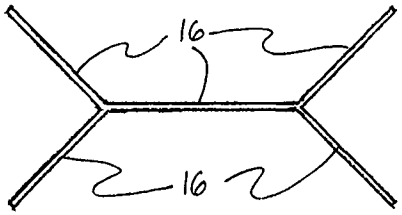
FIG. 37 is a bottom view of FIGS. 31, 32, 35, and 36, prior to being filled.

FIGS. 31 and 32 show perspective views of the bags of FIGS. 29 and 30, respectively. Both are reclosable standup pouches or bags 10, including the front and back panels 36 and an optional longitudinal seam 34. As depicted in FIGS. 37 and 38, the sealed bottom edges 16 are configured to form a number of folds oriented so that they support the bag 10 when filled, thus creating another embodiment of a self-supporting bag 10.

Figure 34:
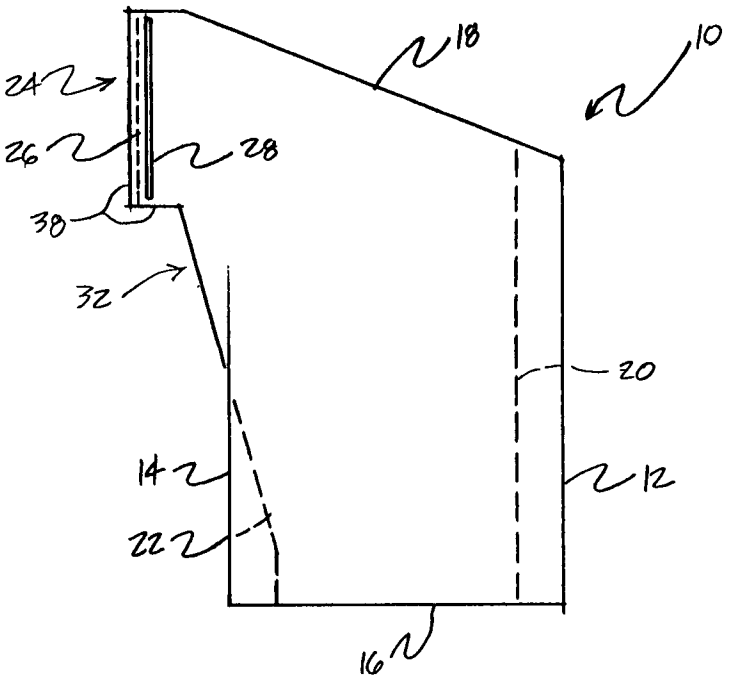
FIG. 34 is a front view of a modification of the reclosable standup pouch or bag of FIG. 30.
Figure 33:
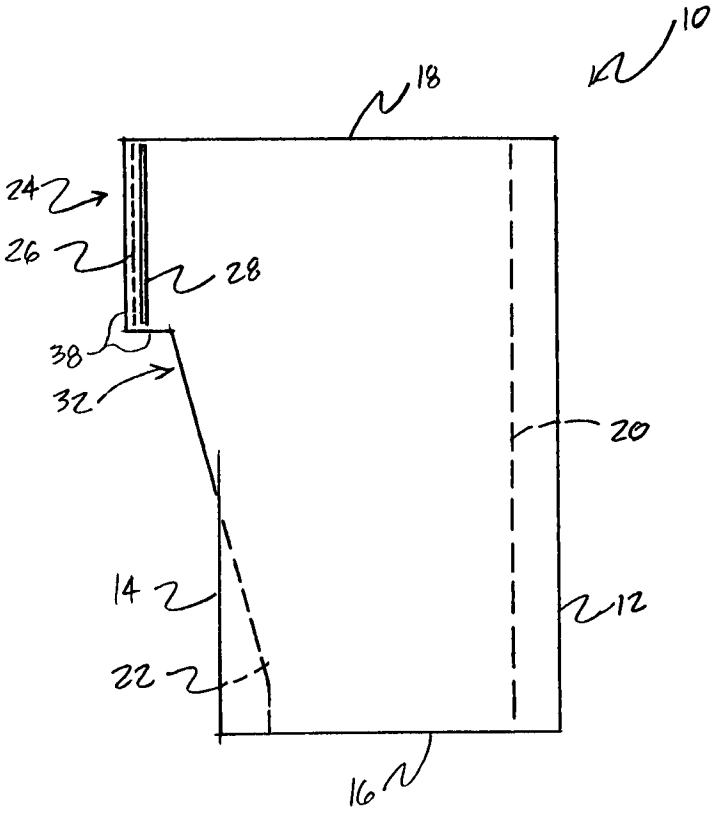
FIG. 33 is a front view of a modification of the reclosable standup pouch or bag of FIG. 29.

FIGS. 33 and 34 are front views of reclosable standup pouches or bags 10 which are a combination of the bags shown in FIGS. 29 and 30 with the outward extending pour spout 32 of FIGS. 5 and 6, respectively. In this embodiment, the pour spout 32 is formed by the spout extension 24, which is located on the upper left side of the reclosable standup pouch or bag 10, and disposed between the sealed left side edge 14 and the sealed top edge 18. The spout extension 24 has sealed edges 38 and a tear strip 26 that is longitudinally oriented and located outwardly of the longitudinally oriented reclosable fastener 28.

Figure 36:
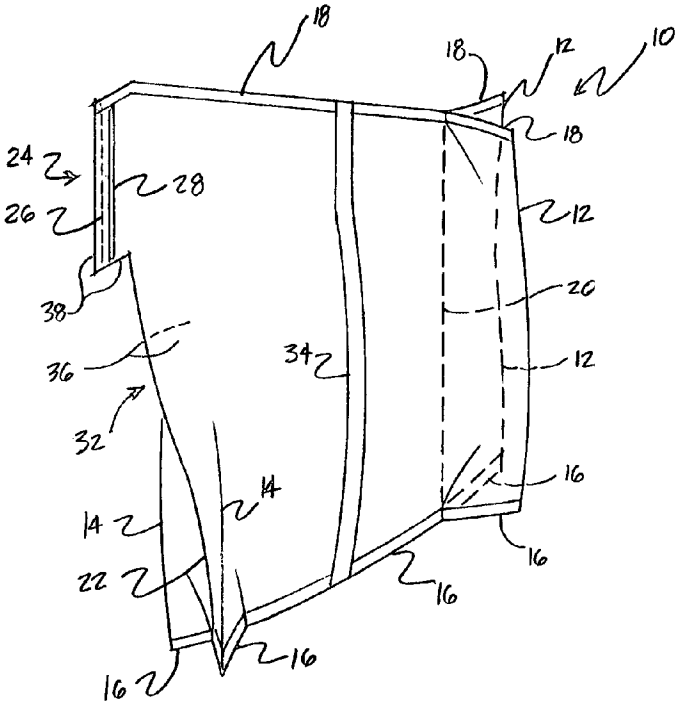
FIG. 36 is a perspective view of the reclosable standup pouch or bag of FIG. 34.
Figure 35:
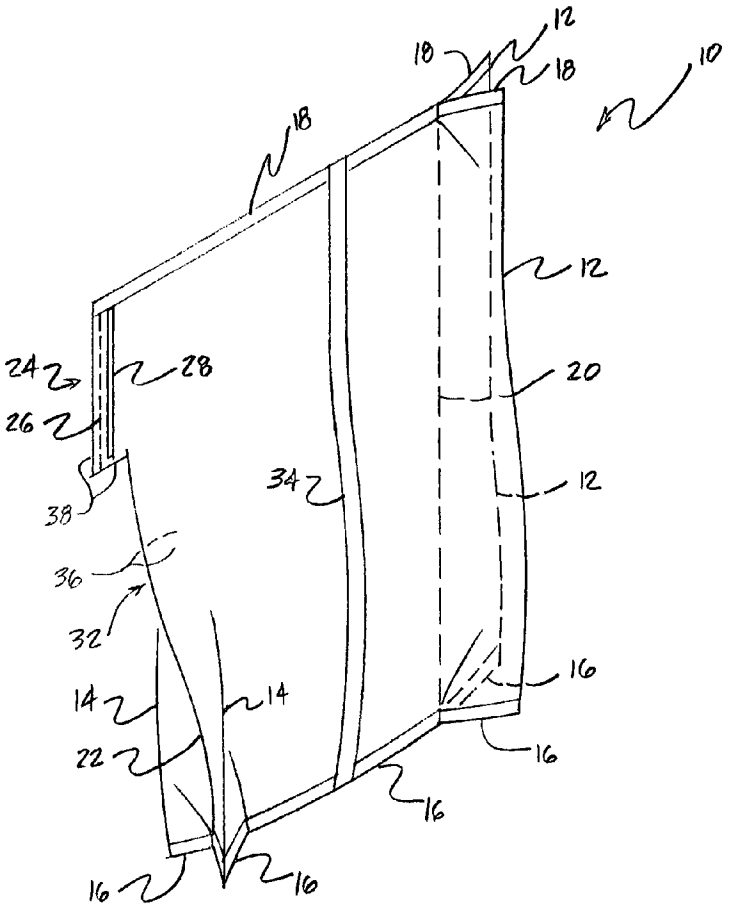
FIG. 35 is a perspective view of the reclosable standup pouch or bag of FIG. 33.

FIGS. 35 and 36 show perspective views of the bags of FIGS. 33 and 34, respectively, and are similar to the views shown in FIGS. 31 and 32 with pour spout 32 extending outward. Both are reclosable standup pouches or bags 10, including the front and back panels 36 and an optional longitudinal seam 34. As depicted in FIGS. 37 and 38, the sealed bottom edges 16 are configured in such a manner that allows them to fold together, when filled, in order to form a flat rectangular shaped bottom that can support the bag 10.

Figure 39:
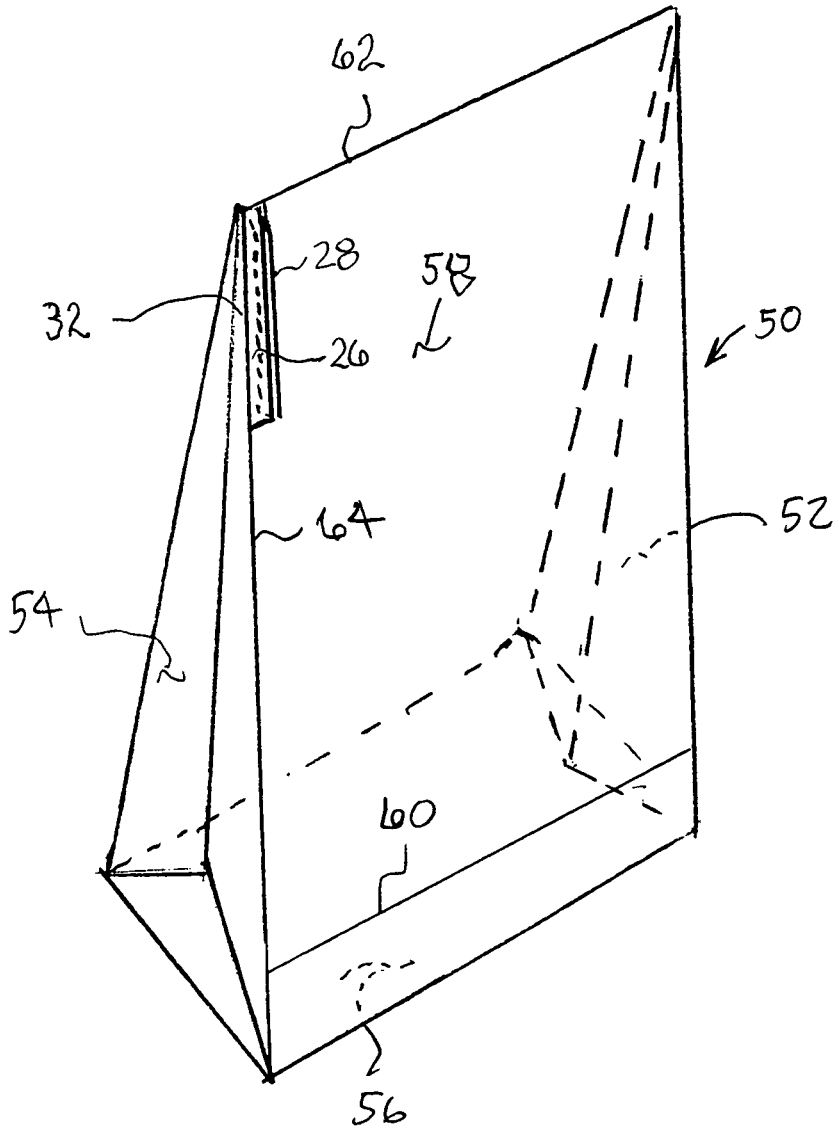
FIG. 39 is a perspective view of an other reclosable bag of the present invention with an opening on the top end of one side fold of a flat top side gusset of the standup bag or pouch of the present invention.
Figure 40:
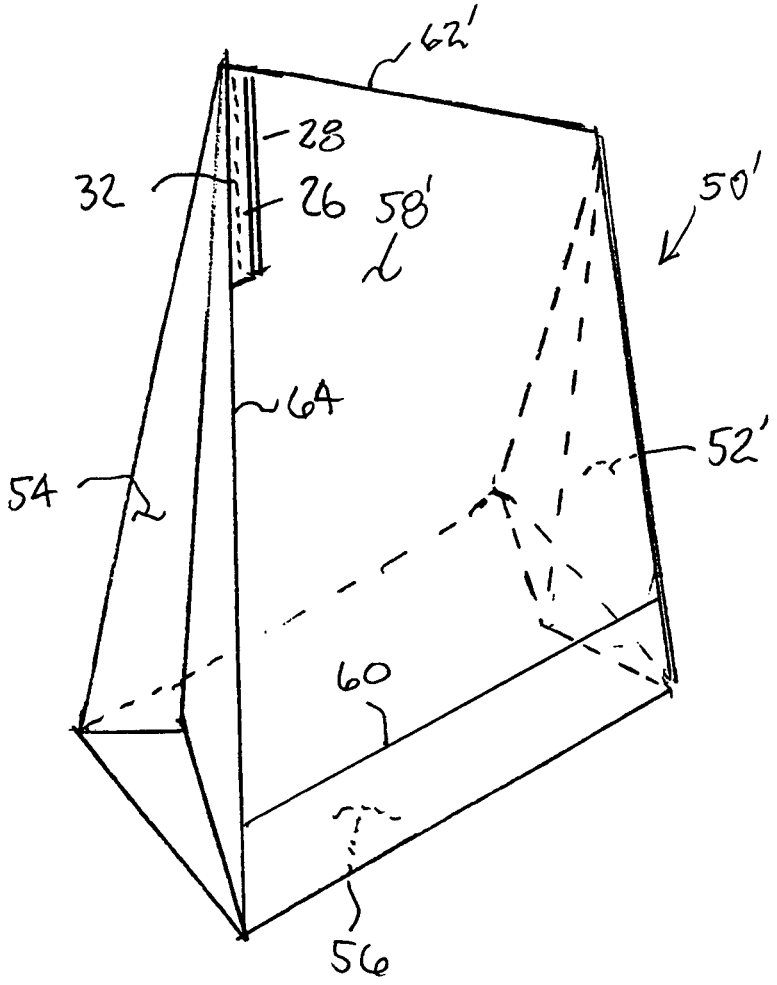
FIG. 40 is a perspective view of an other reclosable bag of the present invention with an opening on the top end of one side fold of a sloping top edge side gusset of the standup bag or pouch of the present invention.

FIGS. 39 and 40 show perspective views of another embodiment of the present invention. In FIG. 39, bag 50 is in a shape that is similar to what is recognized as a typical side gusset grocery bag. Bag 50 includes inward folding right and left side gussets 52 and 54, respectively, a rectangular bottom panel 56 with front side 58 of the bag having a fold line 60 for when the bag is folded flat. Additionally, the top edges 62 of bag 50 are sealed together and a pour spout 32, as discussed above in other embodiments, is included at the upper end of one of the side fold edges 64 of the left side gusset 54. Pour spout 32 is also shown having a reclosable fastener 28 and tear strip 26 as discussed above with other embodiments. Additionally, bag 50 can be modified to extend pour spout 32 outward from edge 64 similar to other embodiments discussed above.

FIG. 40 is substantially the same as FIG. 39 with one difference. Bag 52' of FIG. 40 has a slopping top edge 62' similar to other embodiments discussed above resulting front and back side 58' being parallelograms and right side gusset 52' being shorted than right side gusset 52 of FIG. 39. In other respects, bag 52' of FIG. 40 is the same as bag 52 of FIG. 39.

Attention now turns to the construction of the various bags 10 of the invention. Typically, the bags 10 are constructed by placing two generally rectangular flexible panels together and sealing their edges to create the top and bottom edges 18, 16, and right and left sides 12, 14. Such flexible panels are often constructed of a thermoplastic material so that sealing of their edges is accomplished by heating, however the invention includes any type of panels suitable for storing material, and capable of sealing together by any known process. Similarly, a reclosable fastener is attached to a side of the bag 10, also by heating or other appropriate process, so that opening the reclosable fastener creates an opening allowing material to be transferred into and out of the bag 10. If desired, sealed portions can be created by heat sealing other portions of the bag 10 such as via creation of a secondary seal 40. In embodiments requiring additional panels such as the ovoid bottom of FIG. 3, triangular panel of FIG. 11, or gusseted side edges of FIG. 10, opposite sides of such additional panels are simply heat sealed to the appropriate sides of the two flexible panels to create the bag 10. Likewise, if a folded bottom end is desired as in FIG. 31, the bottom end is folded so as to create an appropriate number and configuration of folds, which are then sealed together.

The foregoing description, for purposes of explanation, uses specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Obviously many modifications and variations are possible in view of the above teachings. For example, many embodiments shown in specific figures can be utilized along with other embodiments shown in other figures, while remaining within the scope of the invention. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A reclosable bag for storing material, comprising:

a top end and a bottom end for resting the reclosable bag upright;

first and second side edges on opposite sides of the reclosable bag, each extending between the top and bottom ends, wherein the first side edge is substantially straight and has a non-gusseted portion that is proximate located near the top end, the first side edge being substantially perpendicular to and longer than the bottom end, and a pour spout located along the non-gusseted portion and oriented to provide, during pouring, a reclosable opening that is substantially parallel to the first side edge, the pour spout having a reclosable fastener which provides access to the reclosable opening and which includes either a zipper or a slider, the reclosable opening being substantially vertical when the reclosable bag is placed in a generally upright position.

2. The reclosable bag of claim 1 wherein the reclosable fastener extends beyond the first side edge so as to facilitate pouring the material from the bag.

3. The reclosable bag of claim 1 wherein the second side edge is a gusseted side edge configured to expand so as to facilitate storing the material within the bag.

4. The reclosable bag of claim 3 wherein the bottom end further has a generally triangular shape.

5. The reclosable bag of claim 3 wherein the first side edge is a gusseted side edge configured to expand so as to facilitate storing the material within the bag.

6. The reclosable bag of claim 5 wherein the bottom end further has a generally rectangular shape.

7. The reclosable bag of claim 5 wherein the bottom end further includes a plurality of folds configured to support the bag, the bag further comprising a lower portion proximate to the bottom end, the lower portion of the bag being folded so as to create the plurality of folds.

8. The reclosable bag of claim 1 wherein the bag further includes a sealed portion proximate to the top end, the sealed portion assisting in directing the material so as to increase control over flow of the material through the pour spout.

9. The reclosable bag of claim 1 wherein the first side edge and the bottom end have an included angle measuring greater than 90 degrees.

10. The reclosable bag of claim 1 wherein the first side edge is a gusseted side edge, the pour spout further including the gusseted side edge so as to facilitate pouring the material from the bag.

11. The reclosable bag of claim 1 wherein the pour spout further includes a tear strip proximate to the reclosable fastener.

12. The reclosable bag of claim 1, wherein the first side edge forms an acute included angle with the top end.

13. The reclosable bag of claim 1, wherein the top end is sealed.

14. The reclosable bag of claim 1, wherein the bottom end is sealed.

15. A self-supporting reclosable bag for storing material, comprising:

a top end;

a bottom end for supporting the bag in a generally upright position;

first and second side edges on opposite sides of the reclosable bag each extending between the top and bottom ends, the first side edge (a) being substantially straight, (b) having a non-gusseted portion located proximate to the top end and (c) being substantially perpendicular to and longer than the bottom end; and a reclosable fastener provided over a reclosable opening located proximate to the top end, being closer to the top end than to the bottom end and being substantially vertical when the bag is placed in the generally upright position, the reclosable fastener including a zipper or a slider, and a pour spout located along the non-gusseted portion of the first side edge, such that the reclosable opening is positioned, during pouring, at the non-gusseted portion of the first side edge.

16. The reclosable bag of claim 15 wherein the reclosable opening extends beyond the first side edge so as to facilitate pouring the material from the bag.

17. The reclosable bag of claim 15 wherein the second side edge is a gusseted side edge configured to expand so as to facilitate storing the material within the bag.

18. The reclosable bag of claim 17 wherein the bottom end further has a generally triangular shape.

19. The reclosable bag of claim 17 wherein the first side edge is a gusseted side edge configured to expand so as to facilitate storing the material within the bag.

20. The reclosable bag of claim 19 wherein the bottom end further has a generally rectangular shape.

21. The reclosable bag of claim 19 wherein the bottom end further includes a plurality of folds configured to support the bag, the bag further comprising a lower portion proximate to the bottom end, the lower portion of the bag being folded so as to create the plurality of folds.

22. The reclosable bag of claim 15 wherein the bag further includes a sealed portion proximate to the top end, the sealed portion assisting in directing the material so as to increase control over flow of the material through the pour spout.

23. The reclosable bag of claim 15 wherein the first side edge and the bottom end have an included angle measuring greater than 90 degrees.

24. The reclosable bag of claim 15 wherein the first side edge is a gusseted side edge, the pour spout further including the gusseted side edge so as to facilitate pouring the material from the bag.

25. The reclosable bag of claim 15 wherein the bag further comprises a tear strip proximate to the reclosable opening.

26. The reclosable bag of claim 15, wherein the first side edge forms an acute included angle with the top end.

27. The reclosable bag of claim 15, wherein the top end is sealed.

28. The reclosable bag of claim 15, wherein the bottom end is sealed.

* * * * *